US011746614B2

(12) United States Patent
Arabnejad Khanouki et al.

(10) Patent No.: US 11,746,614 B2
(45) Date of Patent: Sep. 5, 2023

(54) PULSE GENERATOR FOR VISCOUS FLUIDS

(71) Applicant: Halliburton Energy Services, Inc., Houston, TX (US)

(72) Inventors: Hadi Arabnejad Khanouki, Carrollton, TX (US); Harley Wayne Jones, II, Duncan, OK (US); Koustubh Kumbhar, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 2 days.

(21) Appl. No.: 17/524,275

(22) Filed: Nov. 11, 2021

(65) Prior Publication Data

US 2023/0146423 A1 May 11, 2023

(51) Int. Cl.
*E21B 33/12* (2006.01)
*E21B 33/068* (2006.01)

(52) U.S. Cl.
CPC ..... *E21B 33/12* (2013.01); *E21B 33/068* (2013.01)

(58) Field of Classification Search
CPC ..... E21B 33/12; E21B 33/068
See application file for complete search history.

(56) References Cited

U.S. PATENT DOCUMENTS 3,065,416 A * 11/1962 Jeter ..... E21B 4/02 367/83
4,817,739 A * 4/1989 Jeter ..... E21B 7/18 175/324
5,377,753 A 1/1995 Haberman et al.
6,053,261 A * 4/2000 Walter ..... E21B 7/18 175/243
6,279,670 B1 * 8/2001 Eddison ..... E21B 4/02 175/107
6,457,541 B1 * 10/2002 Schoeffler ..... E21B 23/04 175/324
8,733,469 B2 5/2014 Konschuh et al.
9,494,006 B2 * 11/2016 Mohon ..... E21B 7/24
(Continued)

FOREIGN PATENT DOCUMENTS

CN 2693945 Y 4/2005
CN 201428423 Y 3/2010
(Continued)

OTHER PUBLICATIONS

International Search Report and Written Opinion for Application No. PCT/US2021/059332, dated Aug. 1, 2022.

*Primary Examiner* — Steven A MacDonald
(74) *Attorney, Agent, or Firm* — Thomas Rooney; C. Tumey Law Group PLLC

(57) ABSTRACT

A plugging tool includes an elongated inner housing allowing a first fluid to flow through a hollow interior of the inner housing, a retractable plunger positioned within the inner housing and operable to obstruct the flow of the first fluid into a discharge chamber and resume the flow of the first fluid into the discharge chamber based on a pressure exerted by the first fluid on the retractable plunger, and at least one pressure release valve (PRV) operable to open and release at least a portion of the first fluid from the inner housing based on a pressure exerted by the first fluid on the at least one PRV, wherein operation of the retractable plunger and the at least one PRV generates pulses of the first fluid used to deposit a sealing plug at a target interval of a wellbore.

19 Claims, 6 Drawing Sheets

(56) References Cited

U.S. PATENT DOCUMENTS

| | | | | |
|---|---|---|---|---|
| 10,428,582 | B1 | 10/2019 | Anderson et al. | |
| 11,280,155 | B2 * | 3/2022 | Quero | E21B 43/11 |
| 11,542,777 | B2 * | 1/2023 | Quero | E21B 21/082 |
| 2014/0048283 | A1 * | 2/2014 | Mohon | E21B 7/24 166/177.6 |
| 2015/0053405 | A1 * | 2/2015 | Bakken | E21B 33/14 166/285 |
| 2016/0138391 | A1 * | 5/2016 | Logan | E21B 47/24 367/85 |
| 2016/0194934 | A1 * | 7/2016 | Bakken | E21B 33/134 166/285 |
| 2017/0016289 | A1 * | 1/2017 | Gillis | E21B 4/10 |
| 2017/0211349 | A1 * | 7/2017 | Themig | E21B 34/102 |
| 2018/0252069 | A1 | 9/2018 | Abdollah et al. | |
| 2020/0173249 | A1 * | 6/2020 | Fairweather | E21B 33/13 |
| 2020/0173251 | A1 | 6/2020 | Shafer | |
| 2021/0230964 | A1 * | 7/2021 | Quero | E21B 37/00 |
| 2021/0348480 | A1 * | 11/2021 | Chalker | E21B 33/13 |

FOREIGN PATENT DOCUMENTS

| | | | |
|---|---|---|---|
| WO | 2015/066804 | A1 | 5/2015 |
| WO | 2018224819 | A1 | 12/2018 |
| WO | 2020/185229 | A1 | 9/2020 |
| WO | 2020/246959 | A1 | 12/2020 |

* cited by examiner

PULSE GENERATOR FOR VISCOUS FLUIDS

TECHNICAL FIELD

The present disclosure relates generally to a system and method for cleaning and sealing a wellbore. More specifically, though not exclusively, the present disclosure relates to a pulse generator for generating pulses of a viscous fluid for use during plugging and abandonment (P&A) operations.

BACKGROUND

When a well (or zone) reaches the end of its lifetime, it should be permanently plugged and abandoned. Such plug and abandonment (P&A) operations usually include placing one or more wellbore seals (e.g., cement plugs) in the wellbore to isolate the reservoir and other fluid-bearing formations in order to avoid unwanted fluid communication between a formation surrounding the wellbore and a surface of the wellbore. To abandon the wellbore, a multi-step abandonment process is typically executed. For example, the wellbore may be cleaned near a desired location of the wellbore seal. Additionally, wellbore casing may be perforated to provide sealing communication between the wellbore and the formation (and/or between casings). Further, the desired location may be conditioned for sealing and the sealing material such as cement may be installed to seal the wellbore for abandonment.

In operation, each of these steps of the multi-step abandonment process is typically implemented with a separate run into the wellbore. For example, each of the steps may involve a different tool placed at the end of a jointed pipe (or coiled tubing whichever the case may be) and a different process associated with the individual step. Between the steps, the tool may be removed from the wellbore and replaced with a tool associated with a subsequent step of the abandonment process. The cycle of inserting and removing tools into and from the wellbore may be repeated multiple times until the abandonment process is completed. Additionally, some abandonment techniques may involve leaving or otherwise abandoning tool components downhole within the wellbore, and some of the abandonment techniques may require the use of jointed pipe (or coiled tubing) for deployment of the tools.

BRIEF DESCRIPTION OF DRAWINGS

Some specific exemplary embodiments of the disclosure may be understood by referring, in part, to the following description and the accompanying drawings.

Figure 1A:
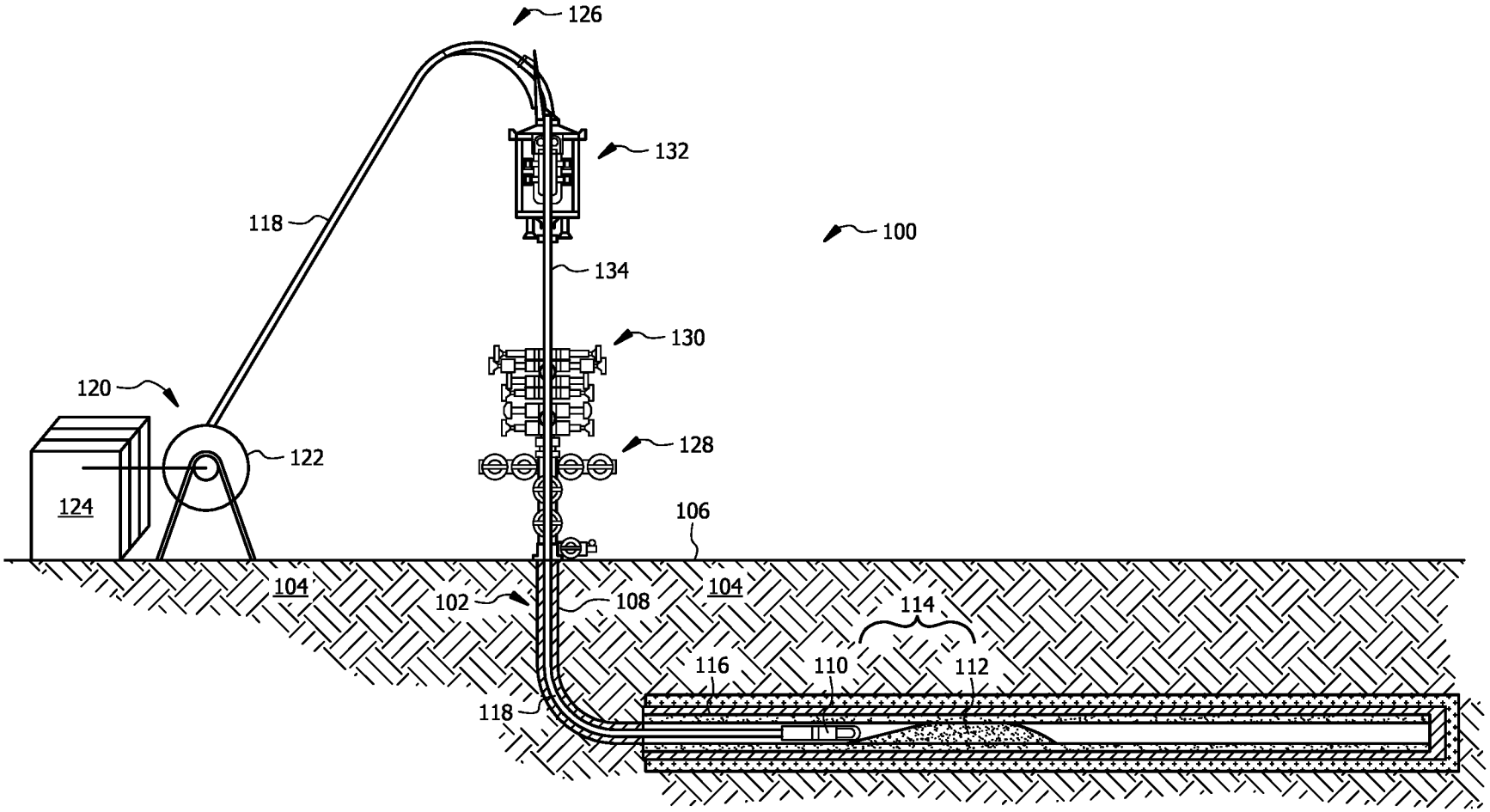
FIG. 1A is a cross-sectional schematic view of an example of a wellbore environment, in accordance with certain embodiments of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modifications, alterations, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

Embodiments of the present disclosure relate to systems and methods for preparing an oil and gas wellbore for abandonment. More specifically, though not exclusively, certain embodiments of the present disclosure relate to systems and methods that prepare the wellbore for sealing, and thereafter, seal the wellbore in a single trip within the wellbore.

In one or more embodiments, a downhole tool assembly includes a wash tool and a plugging tool. The wash tool prepares a target interval within the wellbore for installation of a cement plug by cleaning perforations previously created in a well casing of the wellbore by a perforating tool. Once the perforations have been cleaned, the plugging tool may be used to deposit a seal (e.g., cement plug) at the target interval in a manner that prevents unwanted communication of fluids between the formation surrounding the wellbore and/or a portion of the wellbore and a surface of the wellbore. As described in accordance with certain embodiments of the present disclosure, the disclosed downhole tool assembly is capable of performing the wash operation and the plugging operation in a single trip within the wellbore.

A single trip or run into the wellbore may refer to a downhole tool performing multiple operations within the wellbore without being removed from the wellbore between individual operations. In some examples, the downhole tool assembly may include other tools that may complement the wash tool and the cementing tool, including, but limited to, tools that clean blockages from a path within the wellbore and create perforations on a casing within the wellbore, all in a single trip within the wellbore.

For example, a downhole tool assembly according to some examples may include several tools operating as a bottom hole assembly. Each of the tools of the downhole tool assembly may perform an operation associated with preparing a target interval of the wellbore for sealing or sealing the wellbore at the target interval. For example, a cleaning tool may clean the wellbore during a run-in operation to remove debris from a target interval for installation of a cement plug. A perforating tool may perforate or slot the casing within the wellbore to provide sealing communication between the cement plug and a formation surrounding the wellbore. Further, an additional cleaning tool (e.g., the wash tool) may clean perforating debris from the target interval, and a plugging tool may provide material for a sealing plug (e.g., cement plug) to the target interval within the wellbore. These operations may be performed by a single bottom hole assembly on a single run into the wellbore.

Further, the downhole tool may be delivered downhole within the wellbore using coiled tubing, which may enable installation of the cement plug within a live well.

The downhole tool assembly in accordance with certain embodiments of the present disclosure provides several advantages over the existing downhole tools for preparing a wellbore for sealing and for sealing the wellbore.

Current market solutions for P&A operations are complex, expensive and may require multiple trips into the wellbore to complete plugging of the wellbore. For example, most commercially available tools used in P&A operations have complicated designs and constructions, and thus, are expensive to manufacture. The downhole tool assembly according to certain embodiments of the present disclosure has a simple design and construction, and thus, is easy to manufacture leading to lower costs. Additionally, the downhole tool assembly is a single trip tool which further reduces costs.

Commercially available P&A tools are also slower to deploy in the wellbore and most often need expert personnel at location to run and monitor the tools. For example, most existing P&A downhole tool assemblies include a cup tool that needs to be lowered slowly in the wellbore to avoid damaging the cup tool. Further, owing to their complex design and construction, existing P&A tools need expert personnel on location to run and monitor the tools.

To the contrary, owing to a simple design and construction, the downhole tool assembly in accordance with certain embodiments of the present disclosure is faster to deploy in the wellbore. For example, in some embodiments, the downhole tool assembly does not include a cup tool and thus can be lowered relatively faster in the wellbore than existing P&A tools. Further, the simple design and construction makes the downhole tool assembly easy to operate. Thus, the downhole tool assembly requires reduced or no expert personnel at location to operate the downhole tool assembly.

Some commercially available cleaning tools use fluidic oscillator technology to create bursts of pulsating pressure waves of low viscosity fluids such as acid or brine, enabling pinpoint placement of the fluid to treat the near-wellbore area and help restore maximum injection. The fluid pulses provide higher injectivity for better penetration of the acid and brine into tight spaces within perforations to provide better cleaning. However, these cleaning tools do not work with high viscosity fluids such as cement.

Some existing cementing tools include cup packers that are designed to force cement into the perforations with high pressure only. However, relying on pressure alone to force the high viscosity cement into the perforations does not work well to inject the fluid in tiny spaces within the perforations and micro annulus in the wellbore so that the fluid occupies the tiny spaces to provide a better seal. It has been found that pulsing the cement may provide higher injectivity and penetration to the cement allowing the cement to be reliably injected into tight spaces within the perforations and micro annulus in the wellbore to provide better sealing. However, existing tools do not have the capability to pulse high viscosity fluids such as cement.

The downhole tool assembly in accordance with certain embodiments of the present disclosure includes a plugging tool that can generate low frequency and high amplitude (e.g., high pressure) pulses of high viscosity fluids such as cement slurry to provide better injectivity and penetration of the high viscosity fluids into perforations and micro annulus within the wellbore. Thus, the plugging tool provides a better seal as compared to the existing sealing tools.

Additionally or alternatively, in certain embodiments, the discussed downhole tool assembly provides enhanced perforation cleaning using the wash tool with a high frequency jetting system for brine or acid placement in combination with enhanced cement bond with low frequency high amplitude (e.g., high pressure) jetting system for cement placement using the plugging tool.

Additional advantages of the downhole tool assembly in accordance with certain embodiments of the present disclosure include no requirement of pipe movement for tool activation, no requirement of ball drops for tool activation and a substantially mechanical system with little to no electronic components.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure.

FIG. 1A is a cross-sectional schematic view of an example of a wellbore environment 100, in accordance with certain embodiments of the present disclosure. When a well 102 is damaged or otherwise unusable, operations may be performed on the well 102 to either remediate the damage or to abandon the well 102. Remediating the well may involve installing cement within the wellbore to repair a damaged section of casing. The added layer of cement may maintain integrity of the damaged casing during future operations. Further, when an oil and gas well is no longer in use, plugging and abandonment (P&A) operation may be performed. Abandonment may involve ending unwanted fluid communication between a formation 104 surrounding the well 102 and a surface 106 of the well 102. To end this fluid communication between the formation 104 and the surface 106, a cement plug in sealing communication with the formation 104 may be installed within a wellbore 108 of the well 102.

A downhole tool assembly 110 (e.g., a bottom hole assembly) may be used to prepare the wellbore 108 for installation of the cement plug and also for the installation of the cement plug within the wellbore 108. For example, the downhole tool assembly 110 may include multiple tools or subs capable of performing varying operations for installation of the cement plug within the wellbore 108. In an example, the downhole tool assembly 110 may include a cleaning tool capable of cleaning debris 112 from the wellbore 108 when the downhole tool assembly 110 is run into the wellbore 108.

Figure 1B:
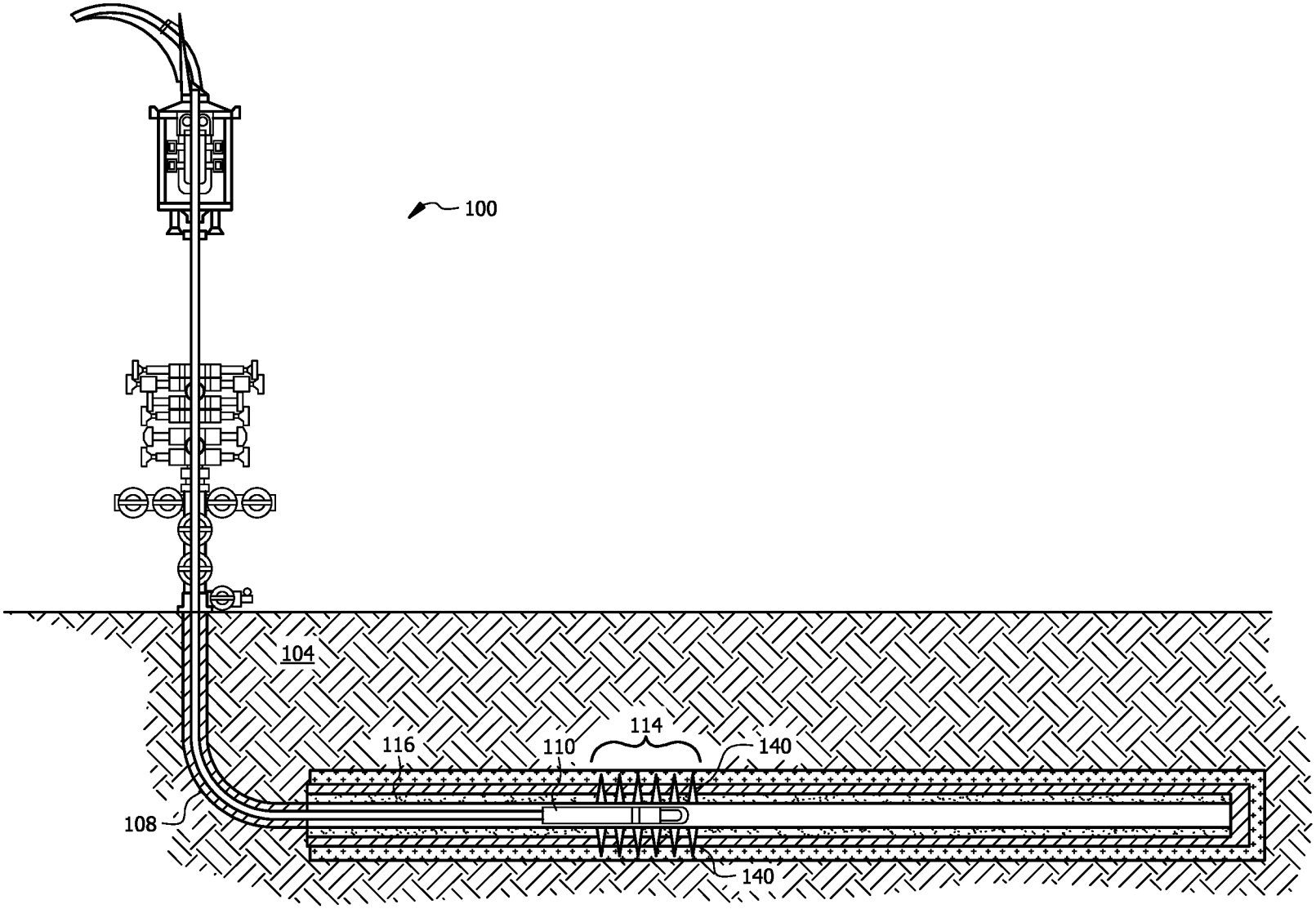
FIG. 1B is a cross-sectional view of the wellbore environment of FIG. 1A during a perforating stage, in accordance with certain embodiments of the present disclosure.

The downhole tool assembly 110 may further include a perforating tool which, once the downhole tool assembly 110 reaches a target interval 114 of the wellbore 108, may perform a perforating or slotting operation through a casing 116 to create a path for the cement plug to achieve sealing communication with the formation 104. In an example, the target interval 114 may be a location at which the cementing plug is installed. In one example, an abrasive slurry may be pumped through the perforating tool through at least one hydraulic jet toward the casing 116 at high flow rate to generate perforations or slots within the casing 116. The perforations or slots eventually enable a sealing communication between the cement plug and the formation 104. Other examples of the perforating tool may include explosive, mechanical, or chemical methods to create the perforations or slots. FIG. 1B is a cross-sectional view of the wellbore environment 100 of FIG. 1A during a perforating stage. As shown, perforations 140 have been created through the casing 116 by a perforating tool of the downhole tool assembly 110 to eventually provide sealing communication between the cement plug and the formation 104.

The downhole tool assembly 110 may further include a wash tool which, after perforating or slotting the casing 116, may clean perforation debris away from the perforations or slots 140 in the casing 116 using fluid oscillator technology. Cleaning the debris from the perforations or slots 140 in the casing 116 may prepare the target interval 114 for the cementing process associated with installing the cement plug. In an example, the wash tool may jet oscillating water, brine, spotting acid, solvent, or other cleaning agents at the target interval 114 to remove any perforating debris or material buildup away from the target interval 114. By removing the debris and buildup from the target interval 114, sealing communication between the cement plug and the formation 104 may be improved.

Figure 1C:
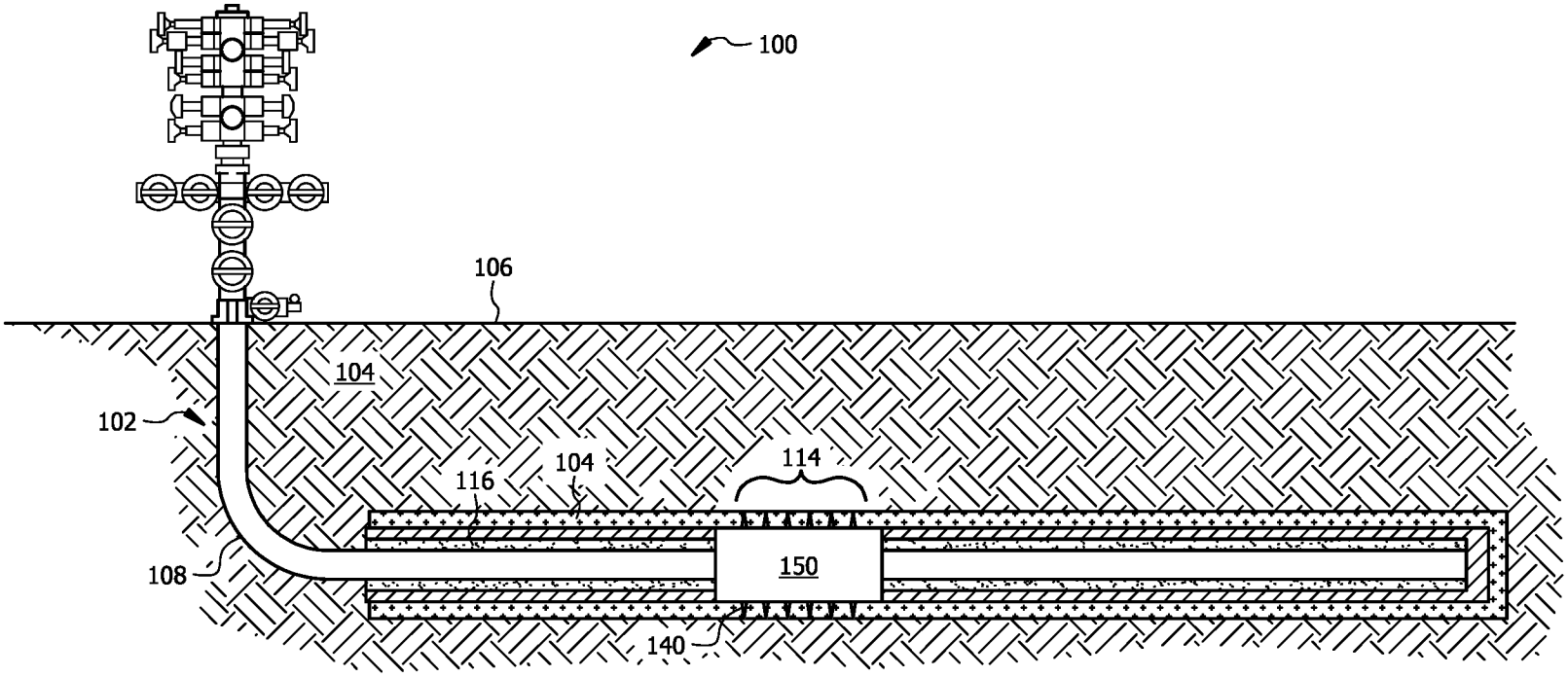
FIG. 1C is a cross-sectional view of the wellbore environment of FIG. 1A upon completion of installation of a cement plug, in accordance with certain embodiments of the present disclosure.

The downhole tool assembly may further include a plugging tool which, after the perforations have been cleaned, may place a cement plug at the target interval 114 in sealing communication with the formation 104. In one example, one or more large flow ports of the plugging tool may layer or otherwise place the cement for the cement plug at the target interval 114. While the cement plug is described herein as being made of cement, a sealant plug or plug made from a sealant combined with cement may also be used. In an example, the sealant may be a hardening resin capable creating sealing communication with the formation 104 surrounding the wellbore 108. FIG. 1C is a cross-sectional view of the wellbore environment 100 of FIG. 1A upon completion of installation of a cement plug, in accordance with certain embodiments of the present disclosure. As shown, a cement plug 150 is installed at interval 114 within the wellbore 108 providing sealing communication between the formation 104 and the wellbore 108.

It may be noted that while the downhole tool assembly 110 is discussed as having each of a cleaning tool, a perforating tool, a wash tool, and a plugging tool, a skilled person may appreciate that the downhole tool assembly 110 may include any one or more of these tools and may further include additional tools to complement one or more of these tools.

As illustrated in FIG. 1A, the downhole tool assembly 110 is coupled to an end of coiled tubing 118. The coiled tubing 118 may be deployed with the downhole tool assembly 110 into the wellbore 108 using a coiled tubing system 120. In an example, the coiled tubing system 120 may include a reel 122 that stores unused coiled tubing 118 and turns to inject or retract the coiled tubing 118 within the wellbore 108. The coiled tubing system 120 may also include multiple fluid storage tanks 124. The fluid storage tanks 124 may store fluid provided by the coiled tubing system 120 to the downhole tool assembly 110 to clean the wellbore 108, to perforate or slot the casing 116, to clean debris and buildup from the slotted or perforated areas of the casing 116, to install a cement plug, or any combination thereof.

When deploying the downhole tool assembly 110 into the wellbore 108 using the coiled tubing system 120, the coiled tubing may be run through a gooseneck 126. The gooseneck 126 may guide the coiled tubing 118 as it passes from a reel orientation in the reel 122 to a vertical orientation within the wellbore 108. In an example, the gooseneck 126 may be positioned over a wellhead 128 and a blowout preventer 130 using a crane (not shown).

The gooseneck 126 may be attached to an injector 132, and the injector 132 may be attached to a lubricator 134, which is positioned between the injector 132 and the blowout preventer 130. In operation, the injector 132 grips the coiled tubing 118 and a hydraulic drive system of the injector 132 provides an injection force on the coiled tubing 118 to drive the coiled tubing 118 within the wellbore 108. The lubricator 134 may provide an area for staging tools (e.g., the downhole tool assembly 110) prior to running the tools downhole within the wellbore 108 when the wellbore 108 represents a high-pressure well. Further, the lubricator 134 provides an area to store the tools during removal of the tools from the high-pressure well. That is, the lubricator 134 provides a staging area for injection and removal of tools into and from a high-pressure well (e.g., a live well).

While the wellbore environment 100 is depicted as using the coiled tubing 118 to install the downhole tool assembly 110 within the wellbore 108, other tool conveyance systems may also be employed. For example, the wellbore environment 100 may include a jointed pipe system to install the downhole tool assembly 110 within the wellbore 108. Additionally, while the wellbore environment 100 is depicted as a land-based environment, the downhole tool assembly 110 may also be similarly introduced and operated in a subsea based environment.

Figure 2A:
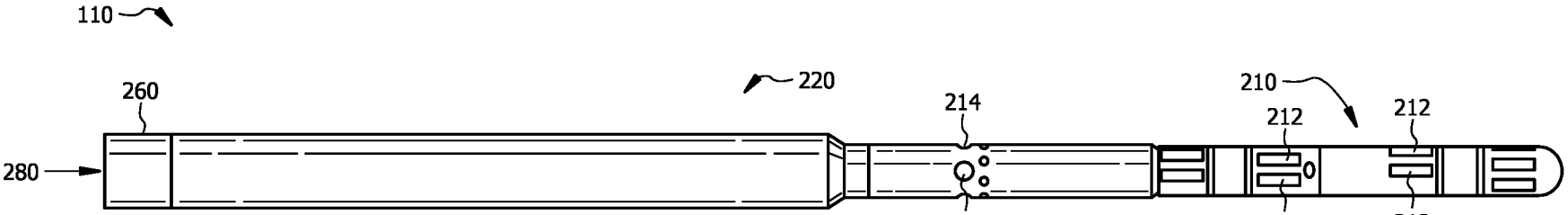
FIG. 2A is a schematic view of an example of the downhole tool assembly, in accordance with certain embodiments of the present disclosure.

FIG. 2A is a schematic view of an example of the downhole tool assembly 110, in accordance with certain embodiments of the present disclosure. As shown, at the downhole end of the example downhole tool assembly 110 a wash tool 210 is installed. A plugging tool 220 may be positioned uphole from the wash tool 210. The downhole tool assembly 110 including the wash tool 210 and the plugging tool 220 may also include a connector 260 positioned at an uphole end of the downhole tool assembly 110. The connector 260 may connect the downhole tool assembly 110 with a work string (e.g., the coiled tubing 118, jointed pipe, etc.). Further, the connector 260 may be any type of connector to suit a particular work string of the wellbore environment 100.

In one or more embodiments, the wash tool 210 may use fluid oscillator technology to clean debris from perforations or slots 140 in the casing 116 to prepare the target interval 114 for the cementing process associated with installing the cement plug. For example, the wash tool 210 may jet oscillating water, brine, spotting acid, solvent, or other cleaning agents at the target interval 114 to remove any perforating debris or material buildup away from the target interval 114. By removing the debris and buildup from the target interval 114, sealing communication between the cement plug and the formation 104 may be improved.

The perforations or slots 140 may have been previously created in the casing 116 at the target interval 114 of the wellbore 108 by using a perforating tool. The perforating tool may perform a perforating or slotting operation through the casing 116 to create a path for the cement plug, when installed, to achieve sealing communication with the formation 104. In certain embodiments, the perforating tool may be a separate tool that is used to perforate the casing 116 in a separate run of the perforating tool into the wellbore 108. In certain alternative embodiments, the perforating tool may be part of the example downhole tool assembly 110 and may be installed at the downhole end of the downhole tool assembly 110 positioned downhole from the wash tool 210. In this case, the downhole tool assembly 110 may perforate the casing 116, wash the perforations 140 and cement the wellbore 108 in a single run into the wellbore 108.

After the perforating or slotting operation is completed by a perforating or slotting tool, a low viscosity fluid such as brine or acid may be pumped in the flow direction 280 (e.g., through the coiled tubing 118) into the downhole tool assembly 110. The low viscosity fluid flows through the plugging tool 220 into the wash tool 210 and is diverted to one of more oscillating side ports 212 of the wash tool 210. The oscillating side ports 212 transmit fluid into the wellbore 108 in an oscillating manner to provide a thorough flush of the perforations or slots 140 cut through the casing 116. For example, the oscillating fluid may flow through the oscillating side ports 212. The fluid that flows through the oscillating side ports 212 may include any low viscosity fluid including, but not limited to a spotting acid, a solvent, or another cleaning agent to remove buildup, scale, or any other debris from within the wellbore 108, from the perforations 140 or from the formation 104. Further, the fluid flowing through the oscillating side ports 212 may place a conditioning treatment within the perforations or slots 140 to prepare the target interval 114 for subsequent material placement (e.g., installation of the cement plug). In one or more embodiments, wash tool 210 may provide the fluid with pulsating resonance as a cyclic output. For example, the cyclic output may include high frequency pulses (e.g., 100 Hz to 300 Hz) at low fluid pressure amplitude with a flow rate in the range of 0.25 barrels (bbl)/min and 10 bbl/min. The high frequency low pressure fluid pulses output from the oscillating side ports 212 may help break up any consolidated fill within the perforations or the slots 140, and the pulse and flow aspect of the cyclic output may also provide an ability to flush any fill from irregular channels or profiles of the perforations or the slots 140. Further, when the wash tool 210 is operated where a hydrostatic load is present, the cyclic output may also create a localized Coriolis force around the downhole tool assembly 110. This may ensure a full coverage flush across the target interval 114. While the wash tool 210 is depicted, other cleaning tools capable of cleaning or otherwise pre-treating the target interval 114 may also be used. Further, the downhole tool assembly 110 may be moved uphole and downhole in several passes along the interval 114 within the wellbore 108 to flush an entirety of the target interval 114. It may be noted that the numeral ranges of the various parameters (e.g., frequency, pressure, flow rate etc.) discussed in this disclosure are exemplary and various tools can be tuned or adapted to implement other numerical ranges of the parameters.

The plugging tool 220 is designed to place a cement plug at the target interval 114 in sealing communication with the formation 104. In one or more embodiments, once the perforations 140 have been cleaned by the wash tool 210, cement may be pumped via the coiled tubing 118 into the downhole tool assembly 110 from an uphole end 290 of the plugging tool 220. The cement may exit one or more cement ports 214 provided at a downhole end 292 of the plugging tool 220 into the wellbore 108 and occupy the target interval 114 of the wellbore to provide the sealing communication with the formation 104. In one or more embodiments, the plugging tool 220 can generate low frequency and high amplitude (e.g., high pressure) pulses of high viscosity fluids such as cement slurry to provide better injectivity and penetration of the high viscosity fluids into perforations 140 and micro annulus within the wellbore. This allows the plugging tool 220 to provide a better seal as compared to the existing plugging tools. For example, the plugging tool 220 may produce fluid pulses with frequency ranging from 1 to 40 Hz, fluid pressure ranging from 500 to 2000 PSI and flow rate of the fluid ranging from 0.5 to 10 bbl/min.

Figure 2B:
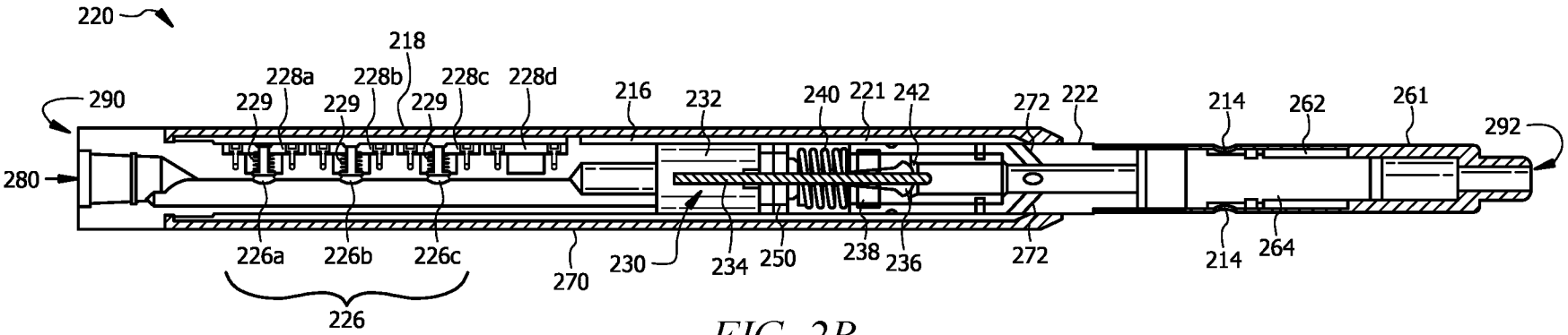
FIG. 2B is a cross-sectional view of a portion the downhole tool assembly showing the internal construction of the plugging tool, in accordance with certain embodiments of the present disclosure.

FIG. 2B is a cross-sectional view of a portion the downhole tool assembly 110 showing the internal construction of the plugging tool 220, in accordance with certain embodiments of the present disclosure. As shown in FIG. 2B, the plugging tool 220 includes an elongated inner housing 216 which includes a Pressure Release Valve (PRV) sub 218, a plunger housing 221 and a bypass sub 222 arranged sequentially from the uphole end 290 to the downhole end 292 of the plugging tool 220. A fluid (e.g., cement slurry) pumped into the plugging tool 220 from the uphole end 290 in direction 280 towards the downhole end 292 passes through a hollow interior of the inner housing 216. The PRV sub 218 may be provided with one or more PRVs 226 that allow fluid to exit from the PRV sub 218 of the inner housing 216 when a pressure exerted by the fluid on the PRVs 226 exceeds a pre-selected threshold pressure. For example, as shown in FIG. 2B, the PRV sub 218 includes PRVs 226*a*, 226*b* and 226*c* secured to the PRV sub 218 using respective cover plates 228*a*, 228*b* and 228*c* affixed to the PRV sub 218. One or more blind PRV cover plates 228*d* may be provided for addition of additional PRVs 226 as and when needed. In one or more embodiments, each PRV 226 may include a PRV spring 229 that keeps the PRV 226 normally closed. The fluid pressure must overcome an opposing force of a PRV spring 229 to open a corresponding PRV 226. In other words, the threshold pressure should at least equal or exceed the opposing force of the PRV spring 229. The PRV springs 229 restore the PRVs 226 to their original closed position when the fluid pressure drops below the threshold pressure required to open the PRVs 226.

The plunger housing 221 houses a floating plunger assembly 230 including a plunger base 232, a plunger shaft 234 and a plunger head 236. The plunger assembly 230 is designed to move back and forth along the length of the inner housing 216/plunger housing 221. A neck portion of the plunger shaft 234 near the plunger head 236 is supported by an anchor 238 secured to the plunger housing 221 (e.g., using screws, welding, or other commonly known methods). The anchor 238 is designed to allow movement of the plunger shaft 234 along the length of the plunger housing 221 while supporting the plunger shaft 234. A plunger seat 242 may be positioned downhole from the plunger assembly 230, wherein when the plunger assembly 230 is pushed downhole by the fluid flow within the inner housing 216, the plunger head 236 seals against the plunger seat 242 to obstruct the flow of the fluid further downhole from the plunger seat 242. A plunger spring 240 may be mounted on the plunger shaft 234 and positioned between the plunger base 232 and the anchor 238 such that the plunger spring 240 is pressed against the anchor 238 when the plunger base 232 is pushed downhole by the fluid pressure. When compressed, the plunger spring 240 exerts an opposing force on the plunger assembly 230 and pushes the plunger assembly 230 uphole and away from the plunger seat 242 by pushing against the plunger base 232 in the uphole direction. This moves the plunger head 236 away from the plunger seat 242, thus resuming fluid flow downhole from the plunger seat 242. Generally, to push the plunger assembly 230 in the downhole direction, the fluid flow in the inner housing 216 needs to overcome an opposing force exerted by the plunger spring 240 on the plunger base 232 in the uphole direction. In other words, the plunger assembly 230 is pushed downhole when the fluid flow exerts a pressure/force on the plunger assembly 230 that at least equals or exceeds a threshold pressure/force needed to overcome the opposing force of the plunger spring 240. When the pressure/force exerted by the fluid flow drops below the threshold, the plunger spring 240 restores the plunger assembly 230 back to an original open position. For example, in a fully open position of the plunger spring 240, the plunger base 232 is pushed by the plunger spring 240 to its leftmost position such that the plunger head 234 does not obstruct fluid flow through the plunger seat 242. In one or more embodiments, the plunger base 232 includes one or more ports or openings to allow fluid to flow downhole thorough the plunger base 232. Similarly, the anchor 238 may also include one or more ports or openings to allow fluid to flow downhole through the anchor 238.

As shown in FIG. 2B, the bypass sub 222 is positioned downhole from the plunger housing and receives fluid passing through the plunger seat 242. The bypass sub 222 is designed to receive the portion of the fluid that exits out of the PRV sub 218 through the PRVs 226. An outer housing 270 may be positioned concentrically over the inner housing 216 creating an annulus between an outer surface of the inner housing 216 and an inner surface of the outer housing 270. At least a portion of the annulus between the inner housing 216 and the outer housing 270 may form a bypass channel carrying the portion of the fluid from the PRVs 226 to the bypass sub 222. Bypass tubes 272 are designed to communicate the fluid from the annulus between the housings to the interior of the bypass sub 222 to join the main fluid stream flowing through the bypass sub 222. In one embodiment, the plunger seat 242 may be a part of the bypass sub 222. For example, the plunger seat 242 may be attached to or otherwise built into an uphole end of the bypass sub 222.

The plugging tool 220 may further include a discharge sub 261 to discharge the fluid (e.g., cement slurry) out from the plugging tool 220 through cement ports 214. Fluid passing through the plunger housing 221 and the bypass sub 222 enters a discharge chamber 264 of the discharge sub 261 before exiting through the cement ports 214. The discharge sub 261 includes a pressure activated sleeve 262 designed to open the cement ports 214 when fluid pressure inside discharge chamber 264 increases beyond a threshold pressure rating of the pressure activated sleeve 262. The threshold pressure rating of the pressure activated sleeve 262 is set above the maximum fluid pressure at which the wash tool 210 operates to avoid the sleeve 262 from activating during normal operation of the wash tool 210. In one or more embodiments, the pressure activated sleeve 262 may include one or more shear pins (not shown) that are designed to shear when pressure inside the discharge chamber 264 increases beyond the threshold pressure rating of the sleeve 262. The sleeve 262 may be configured to open in response to the one or more shear pins shearing.

In one or more embodiments, when the wash tool 210 has finished cleaning the perforations 140, the pumping rate of the low viscosity cleaning fluid (e.g., acid, brine etc.) used to clean the perforations 140 may be significantly increased to increase the fluid pressure in chamber 264 beyond the rated threshold pressure of the sleeve 262 and thus opening the pressure activated sleeve 262 to allow fluids to exit through the cement ports 214. In alternative embodiments, when the wash tool 210 has finished cleaning the perforations 140, cement slurry may be pumped into the downhole tool assembly 110. Since the sleeve 262 is closed at this point, the cement flow is unable to exit via the cement ports 214 and proceeds to the wash tool 210 and attempts to exit via the ports 212 of the wash tool 210. However, ports 212 (and in some cases, the wash tool 210 itself) are not designed to pass a high viscosity fluid such as cement. For example, ports 212 are sized to allow passing of lower viscosity fluids only such as brine and acid. The ports 212 are not sufficiently large to allow a high viscosity fluid to pass freely through the ports 212. Thus, the cement is unable to freely exit from the ports 212 of the wash tool 210 which leads to cement pressure building up in the discharge chamber 264. With more cement flowing into the downhole tool assembly 110, cement pressure in the discharge chamber 264 eventually rises beyond the rated threshold pressure of the pressure activated sleeve 262 thus opening the pressure activated sleeve 262 to allow the cement to exit through the cement ports 214.

In one or more embodiments, operation of the plunger assembly 230 and the PRVs 226 together generate low frequency and high-pressure pulses of a high viscosity fluid such as cement slurry. For example, after the cement ports 214 have been opened as described above, when cement slurry is pumped into the plugging tool 220, the cement starts flowing through the inner housing 216 into the discharge sub 261 and out of the cement ports 214. However, owing to the high viscosity of the cement, the flow of the cement through the plunger housing 221 may push the plunger assembly 230 in the downhole direction with a pressure/force that at least equals or exceeds a threshold pressure/force required to overcome the opposing force of the plunger spring 240, thus causing the plunger assembly 230 to move along with the cement flow. As the plunger assembly 230 moves in the downhole direction, the plunger base 232 compresses the plunger spring 240, and eventually the plunger head 236 seals against the plunger seat 242 obstructing cement flow to the discharge sub 261. The sudden stopping of the fluid flow creates a pressure spike similar to a water hammer wave. The pressure spike travels in the uphole direction from the plunger seat 242 and acts on the PRVs 226 causing the pressure exerted on the PRVs to exceed the threshold fluid pressure required to open the PRVs. Consequentially, the PRVs 226 open to release a portion of the fluid from the inner housing 216, thus lowering the fluid pressure within plunger housing 221 to below the threshold fluid pressure required to keep the plunger assembly 230 pressed against the plunger seat 242. The lower fluid pressure within the plunger housing 221 allows the plunger spring 240 to overcome the fluid force pushing against the plunger assembly 230 and push the plunger assembly 230 away from the plunger seat 242 and back to the original position of the plunger assembly 230. As the fluid resumes to flow through to the discharge sub 261, the fluid pressure within the inner housing 216 starts building up again and the above cycle continues. As long as the cement slurry is pumped into the plugging tool 220 and cement flow is maintained at a rate that that at least equals or exceeds the threshold pressure/force required to move the plunger assembly 230, the plunger assembly 230 and the PRVs 226 continuously cycle through the above steps to generate low frequency and high pressure pulses of cement that are delivered through the cement ports 214.

Figure 3:
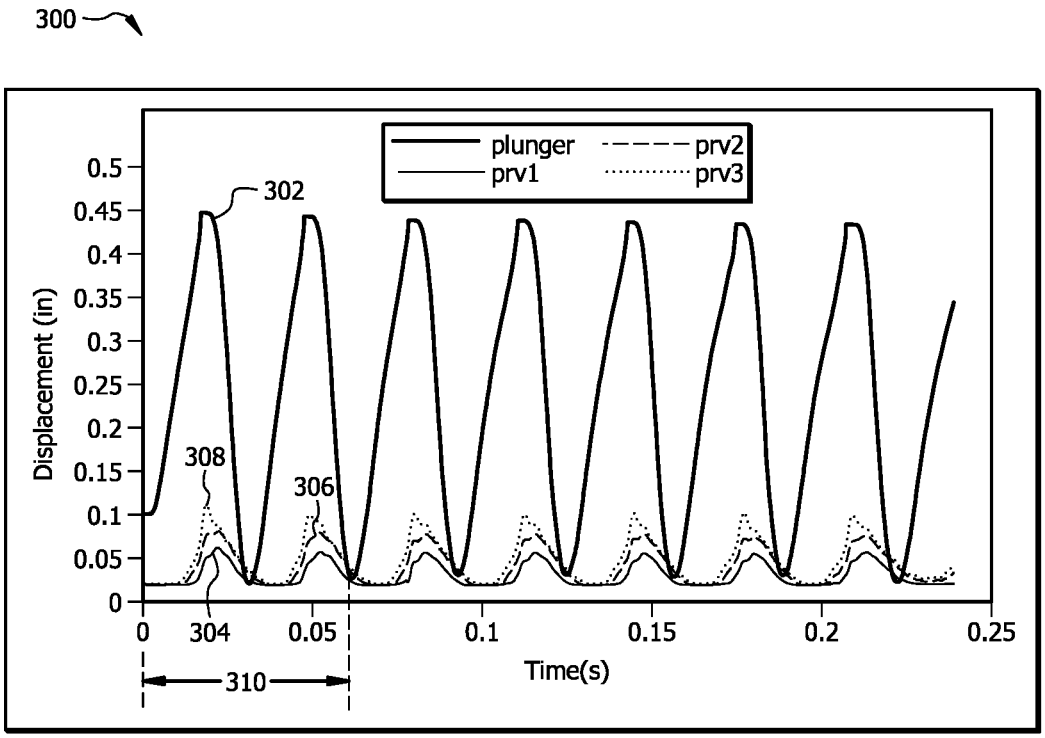
FIG. 3 illustrates an example plot of displacement with respect to time of the plunger assembly and three PRVs during operation of the plugging tool, in accordance with certain embodiments of the present disclosure.

FIG. 3 illustrates an example plot 300 of displacement with respect to time of the plunger assembly 230 and three PRVs 226 during operation of the plugging tool 220, in accordance with certain embodiments of the present disclosure. Curve 302 corresponds to the operation of the plunger assembly 230 and shows displacement of the plunger assembly 230 over time. Curves 304, 306 and 308 correspond to the operations of PRVs 226*a*, 226*b* and 226*c* respectively and show displacement of the respective PRVs 226 over time. A displacement of '0 inches' represents the initial resting positions of each of the plunger assembly 230 and the PRVs 226. The resting position of the plunger assembly may be a leftmost position of the plunger assembly 230 when the plunger spring 240 is fully open and the plunger head 236 is not pressed against the plunger seat 242 allowing free flow of fluid into the discharge chamber 264. The resting position of each of the PRVs 226 corresponds to a closed position of the PRVs 226. Each cycle 310 generates one pulse of the fluid. As shown, by displacement curve 302, during a first cycle 310, the plunger assembly 230 starts moving downhole towards the plunger seat 242 as fluid pressure in the plunger housing 221 equals or exceeds a threshold pressure required to move the plunger assembly. At peak displacement (e.g., around 0.45 inches), the plunger head 236 may seal against the plunger seat 242 and obstruct fluid flow into the discharge chamber 264. The sudden stopping of the fluid flow generates a water hammer wave that travels uphole from the plunger seat 242 and sequentially acts on PRVs 226 in the uphole direction. For example, the pressure wave first reaches PRV 226*c* and exerts pressure above the required fluid pressure to open the PRV 226*c*. The pressure wave then sequentially opens PRVs 226*b* and then 226*a*. The sequential opening of the PRVs is shown in FIG. 3 by the leading displacement curve 308 of PRV 226 followed by the displacement curves of PRVs 226*b* and 226*a* in each cycle 310. As the PRVs 226 are opened (shown as peak displacement of each PRV curve), the fluid pressure in the housing 216 drops and the plunger assembly 230 starts being pushed back which is shown by the negative displacement of curve 302. As shown, the cycle 310 repeats itself to generate pulses of the fluid.

In one or more embodiments, the resistance of the plunger spring 240 may be high enough so that low viscosity wash fluids (e.g., acid, brine etc.) flowing through the plugging tool 220 to the wash tool 210 (e.g., during a washing phase) do not activate the plunger assembly 230 allowing the low viscosity fluids to flow freely through the plugging tool 220 to the wash tool 210.

In one or more embodiments, while some cement may leak through ports 212 of the wash tool 210, since the ports 212 are not designed to deliver high viscosity fluids such as cement and are too small to support a constant flow of cement, the wash tool 210 resists cement from exiting from the wash tool 210 via the ports 212. This allows sufficient pressure to build up in the discharge chamber 264 for cement pulses to exit from the cement ports 214.

In one or more embodiments, a desired oscillating frequency of the high viscosity fluids (e.g., cement slurry) generated by the plugging tool 220 may be achieved by adjusting one or more parameters including, but not limited to, a stroke length of the piston assembly 230, spring stiffness of the plunger spring 240, spring stiffness of the PRV spring 229, mass of the plunger assembly 230, size of the PRVs 226, size of the discharge ports 214 and fluid flow rate. For example, raising the mass/weight of the plunger assembly 230 may lower the oscillation frequency of the fluid pulses as the plunger assembly 230 may offer a higher resistance to the fluid flow. On the other hand, lowering the mass of the plunger assembly 230 may raise the oscillation frequency of the fluid pulses. Plunger weights 250 may be mounted on the plunger shaft 234 to achieve a desired mass/weight of the plunger assembly. In one embodiment, a stack of springs may be used as the plunger spring 240, wherein each spring from the stack may have a fixed spring resistance. Resistance of the plunger spring 240 may be raised or lowered to a desired value by selecting an appropriate number of springs. Stroke length of the piston assembly 230 may represent a distance travelled by the plunger assembly 230 from its original resting position to the plunger seat 242. The stroke length of the piston assembly 230 may be adjusted by using spring stacking instead of using a single large spring as the plunger spring 240.

While embodiments of the present disclosure are described with reference to a low viscosity fluid such as water or brine and a high viscosity fluid such as cement slurry, it may be appreciated that the downhole tool assembly 110 is customizable for a variety of fluids with varying viscosities.

Figure 4:
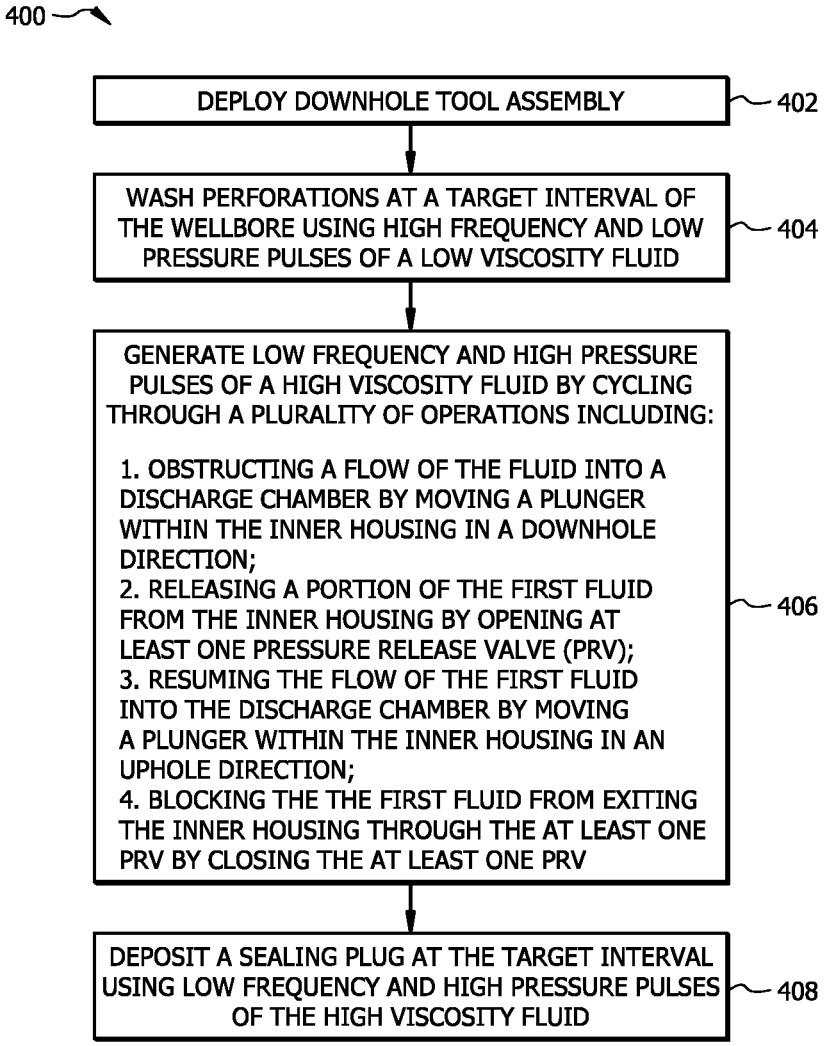
FIG. 4 is a flow chart of a method for operating a downhole tool assembly, in accordance with certain embodiments of the present disclosure.

FIG. 4 is a flow chart of a method 400 for operating a downhole tool assembly (e.g., downhole tool assembly 110), in accordance with certain embodiments of the present disclosure.

The method 400 begins, at 402, by deploying the downhole tool assembly 110 within the wellbore 108. In one or more embodiments, the downhole tool assembly 110 may be deployed within the wellbore 108 using the coiled tubing system 120, a jointed pipe system, or any other system capable of deploying the downhole tool assembly 110 within the wellbore 108.

At 404, the wash tool 210 washes the target interval 114 of the wellbore 108 with pulses of a first fluid (e.g., a low viscosity fluid such as acid and/or brine) at a first frequency and first pressure. As described above, the wash tool 210 may use fluid oscillator technology to clean debris from perforations or slots 140 in the casing 116 in order to prepare the target interval 114 for the cementing process associated with installing the cement plug. For example, the wash tool 210 may jet oscillating water, brine, spotting acid, solvent, or other low viscosity cleaning agents at the target interval 114 to remove any perforating debris or material buildup away from the target interval 114. By removing the debris and buildup from the target interval 114, sealing communication between the cement plug and the formation 104 may be improved.

In one or more embodiments, after a perforating or slotting operation is completed by a perforating or slotting tool, a low viscosity fluid such as brine or acid may be pumped in the flow direction 280 (e.g., through the coiled tubing 118) into the downhole tool assembly 110. The low viscosity fluid flows through the plugging tool 220 into the wash tool 210 and is diverted to one of more oscillating side ports 212 of the wash tool 210. The oscillating side ports 212 transmit fluid into the wellbore 108 in an oscillating manner to provide a thorough flush of the perforations or slots 140 cut through the casing 116. For example, the oscillating fluid may flow through the oscillating side ports 212. The fluid that flows through the oscillating side ports 212 may include any low viscosity fluid including, but not limited to a spotting acid, a solvent, or another cleaning agent to remove buildup, scale, or any other debris from within the wellbore 108, from the perforations 140 or from the formation 104. Further, the fluid flowing through the oscillating side ports 212 may place a conditioning treatment within the perforations or slots 140 to prepare the target interval 114 for subsequent material placement (e.g., installation of the cement plug). In one or more embodiments, wash tool 210 may provide the fluid with pulsating resonance as a cyclic output. For example, the cyclic output may include high frequency pulses (e.g., 100 Hz to 300 Hz) at low fluid pressure amplitude with a flow rate in the range of 0.25 barrels (bbl)/min and 10 bbl/min. The high frequency low pressure fluid pulses output from the oscillating side ports 212 may help break up any consolidated fill within the perforations or the slots 140, and the pulse and flow aspect of the cyclic output may also provide an ability to flush any fill from irregular channels or profiles of the perforations or the slots 140.

At step 406, the plugging tool 220 generates pulses of a second fluid (e.g., a high viscosity fluid such as cement slurry) at a second frequency and second pressure, wherein the second frequency of the pulses the high viscosity fluid is lower than the first frequency of the pulses of the low viscosity fluid generated by the wash tool 210. Further, the second pressure of the pulses of the high viscosity fluid is higher than the first pressure of the pulses of the low viscosity fluid generated by the wash tool 210. The plugging tool 220 generates the low frequency and higher pressure pulses of the second fluid or high viscosity fluid by cycling through a plurality of operations including obstructing a flow of the second fluid into a discharge chamber 264 by moving a plunger 230 within the inner housing 216 in a downhole direction when a pressure exerted by the second fluid on the plunger 230 equals or exceeds a first threshold pressure; releasing a portion of the second fluid from the inner housing 216 by opening at least one pressure release valve (PRV) 226 when the pressure exerted by the second fluid on the at least one PRV 226 equals or exceeds a second pressure threshold; resuming the flow of the second fluid into the discharge chamber 264 by moving the plunger 230 within the inner housing 216 in an uphole direction when the pressure exerted by the second fluid on the plunger 230 falls below the first threshold pressure; and blocking the second fluid from exiting the inner housing 216 through the at least one PRV 226 by closing the at least one PRV 226 in response to the pressure exerted by the second fluid on the at least one PRV 226 falling below the second pressure threshold.

As described above, in one or more embodiments, when the wash tool 210 has finished cleaning the perforations 140, the pumping rate of the first fluid (e.g., low viscosity cleaning fluid such as acid, brine etc.) used to clean the perforations 140 may be significantly increased to increase the fluid pressure in chamber 264 beyond the rated threshold pressure of the sleeve 262 positioned in the discharge sub 261 and thus opening the pressure activated sleeve 262 to allow the fluid to exit through the cement ports 214. In alternative embodiments, when the wash tool 210 has finished cleaning the perforations 140, the second fluid (e.g., high viscosity fluid such as cement slurry) may be pumped into the downhole tool assembly 110. Since the sleeve 262 is closed at this point, the cement flow is unable to exit via the cement ports 214 and proceeds to the wash tool 210 and attempts to exit via the ports 212 of the wash tool 210. However, ports 212 (and in some cases, the wash tool 210 itself) are not designed to pass a high viscosity fluid such as cement. For example, ports 212 are sized to allow passing of lower viscosity fluids only such as brine and acid. The ports 212 are not sufficiently large to allow a high viscosity fluid to pass freely through the ports 212. Thus, the cement is unable to freely exit from the ports 212 of the wash tool 210 which leads to cement pressure building up in the discharge chamber 264. With more cement flowing into the downhole tool assembly 110, cement pressure in the discharge chamber 264 eventually rises beyond the rated threshold pressure of the pressure activated sleeve 262 thus opening the pressure activated sleeve 262 to allow the cement to exit through the cement ports 214.

After the cement ports 214 have been opened as described above, when cement slurry is pumped into the plugging tool 220, the cement starts flowing through the inner housing 216 into the discharge sub 261 and out of the cement ports 214. However, owing to the high viscosity of the cement, the flow of the cement through the plunger housing 221 may push the plunger assembly 230 in the downhole direction with a pressure/force that at least equals or exceeds a threshold pressure/force (e.g. the first threshold pressure mentioned above) required to overcome the opposing force of the plunger spring 240, thus causing the plunger assembly 230 to move along with the cement flow. As the plunger assembly 230 moves in the downhole direction, the plunger base 232 compresses the plunger spring 240, and eventually the plunger head 236 seals against the plunger seat 242 obstructing cement flow to the discharge sub 261. The sudden stopping of the fluid flow creates a pressure spike similar to a water hammer wave. The pressure spike travels in the uphole direction from the plunger seat 242 and acts on the PRVs 226 causing the pressure exerted on the PRVs 226 to exceed the threshold fluid pressure (e.g. the second threshold pressure mentioned above) required to open the PRVs 226. Consequentially, the PRVs 226 open to release a portion of the fluid from the inner housing 216, thus lowering the fluid pressure within plunger housing 221 to below the threshold fluid pressure required to keep the plunger assembly 230 pressed against the plunger seat 242. The lower fluid pressure within the plunger housing 221 allows the plunger spring 240 to overcome the fluid force pushing against the plunger assembly 230 and push the plunger assembly 230 away from the plunger seat 242 and back to the original position of the plunger assembly 230. As the fluid resumes to flow through to the discharge sub 261, the fluid pressure within the inner housing 216 starts building again and the above cycle continues. As long as the cement slurry is being pumped into the plugging tool 220 and cement flow is maintained at a rate that at least equals or exceeds the threshold pressure/force required to move the plunger assembly 230, the plunger assembly 230 and the PRVs 226 continuously cycle through the above steps to generate low frequency and high pressure pulses of cement that are delivered through the cement ports 214.

At 408, the plugging tool deposits a sealing plug at the target interval using the low frequency and high-pressure pulses of the high viscosity fluid (e.g., cement slurry).

Embodiments of the methods disclosed in the method 400 may be performed in the operation of the downhole tool assembly 110. The order of the blocks presented in the method 400 above can be varied—for example, blocks can be reordered, combined, removed, and/or broken into sub-blocks. Certain blocks or processes can also be performed in parallel.

As used below, any reference to a series of examples is to be understood as a reference to each of those examples disjunctively (e.g., "Examples 1-4" is to be understood as "Examples 1, 2, 3, or 4").

One or more embodiments of the present disclosure provide a plugging tool. The plugging includes an elongated inner housing allowing a first fluid to flow through a hollow interior of the inner housing from an uphole end to a downhole end; a retractable plunger positioned within the inner housing and operable to obstruct the flow of the first fluid into a discharge chamber and resume the flow of the first fluid into the discharge chamber based on a pressure exerted by the first fluid on the retractable plunger; and at least one pressure release valve (PRV) operable to open and release at least a portion of the first fluid from the inner housing based on a pressure exerted by the first fluid on the at least one PRV, wherein operation of the retractable plunger and the at least one PRV, while the first fluid is being pumped into the inner housing, generates pulses of the first fluid used to deposit a sealing plug at a target interval of a wellbore.

In one or more embodiments, a first frequency of the pulses of the first fluid generated by the plugging tool is lower than a second frequency of pulses of a second fluid generated by a wash tool used to wash the target interval of the wellbore.

In one or more embodiments, the discharge chamber comprises a pressure activated sleeve, wherein the pressure activated sleeve is configured to open at least one cementing port adjacent to the discharge chamber when a pressure of the first fluid or the second fluid in the discharge chamber equals or exceeds a pressure threshold, wherein the pulses of first fluid exit from the discharge chamber through the at least one cementing port.

In one or more embodiments, the inner housing is configured to allow the second fluid to pass through to the wash tool positioned downhole from the plugging tool.

In one or more embodiments, open to release the first fluid from the inner housing when the pressure exerted by the first fluid on the at least one PRV equals or exceeds a threshold pressure; and close to block the first fluid from exiting the inner housing through the at least one PRV when the pressure exerted by the first fluid on the at least one PRV falls below the threshold pressure.

In one or more embodiments, the plugging tool further includes a plunger seat positioned within the inner housing downhole from the retractable plunger, wherein the first fluid flows through the plunger seat into the discharge chamber.

In one or more embodiments, the plunger comprises a plunger shaft and a plunger head positioned at a downhole end of the plunger shaft; and the plunger is configured to move along the length of the inner housing when pushed by the flow of the first fluid with at least a threshold pressure such that the plunger head seals against the plunger seat to obstruct the flow of the first fluid into the discharge chamber.

In one or more embodiments, the plugging tool further includes at least one plunger spring positioned within the housing near the plunger, wherein the plunger spring is configured to spring load the plunger when the plunger is pushed by the first fluid and retract the plunger away from the plunger seat to resume the flow of the first fluid into the discharge chamber when the pressure exerted by the first fluid on the plunger drops below the threshold pressure.

In one or more embodiments, the plugging tool further includes at least one plunger weight mounted on the plunger, wherein the plunger weight is selected to achieve a pre-selected frequency of the pulses of the first fluid.

In one or more embodiments, the inner housing includes a PRV sub housing the at least one PRV; a plunger housing coupled to the PRV sub and positioned downhole from the PRV sub, wherein plunger housing houses the plunger; and a bypass sub coupled to the plunger housing and positioned downhole from the plunger housing, the bypass sub housing at least the plunger seat.

In one or more embodiments, the bypass sub receives a portion of the first fluid released from the housing by the at least one PRV through a bypass channel.

In one or more embodiments, the plugging tool further includes an outer housing concentrically positioned over the inner housing creating an annulus between an outer surface of the inner housing and an inner surface of the outer housing, wherein the annulus forms at least a portion of the bypass channel.

In one or more embodiments, the first fluid comprises a cement slurry.

One or more embodiments of the present disclosure provide a method for sealing a wellbore using a plugging tool. The method includes pumping a first fluid into an inner housing of the plugging tool and generating pulses of the first fluid by cycling through a plurality of operations. The plurality of operations include obstructing a flow of the first fluid into a discharge chamber by moving a plunger within the inner housing in a downhole direction when a pressure exerted by the first fluid on the plunger equals or exceeds a first threshold pressure; releasing a portion of the first fluid from the inner housing by opening at least one pressure release valve (PRV) when the pressure exerted by the first fluid on the at least one PRV equals or exceeds a second pressure threshold; resuming the flow of the first fluid into the discharge chamber by moving the plunger within the inner housing in an uphole direction when the pressure exerted by the first fluid on the plunger falls below the first threshold pressure; and blocking the first fluid from exiting the inner housing through the at least one PRV by closing the at least one PRV in response to the pressure exerted by the first fluid on the at least one PRV falling below the second pressure threshold.

In one or more embodiments, a first frequency of the pulses of the first fluid generated by the plugging tool is lower than a second frequency of pulses of a second fluid generated by a wash tool used to wash the target interval of the wellbore.

In one or more embodiments, wherein the method further includes opening a pressure activated sleeve positioned in the discharge chamber when a pressure of the first fluid or the second fluid in the discharge chamber equals or exceeds a third pressure threshold, wherein the open pressure activated sleeve allows the pulses of first fluid to exit from the discharge chamber through at least one cementing port adjacent to the pressure activated sleeve.

In one or more embodiments, opening the pressure activated sleeve comprises pumping the first fluid or the second fluid into the plugging tool to increase a corresponding fluid pressure in the discharge chamber to equal or exceed the third pressure threshold.

In one or more embodiments, obstructing the flow of the first fluid into the discharge chamber comprises moving the plunger along the length of the inner housing in the downhole direction such that a plunger head of the plunger seals against a plunger seat to obstruct the flow of the first fluid into the discharge chamber.

In one or more embodiments, resuming the flow of the first fluid into the discharge chamber comprises retracting the plunger away from the plunger seat using a plunger spring positioned near the plunger to resume the flow of the first fluid into the discharge chamber.

In one or more embodiments, the method further includes mounting at least one plunger weight on the plunger to achieve a pre-selected frequency of the pulses of the first fluid.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the elements that it introduces.

What is claimed is:

1. A plugging tool comprising:

an elongated inner housing allowing a first fluid to flow through the inner housing;

a retractable plunger positioned within the inner housing and operable to obstruct the flow of the first fluid into the discharge chamber and resume the flow of the first fluid into the discharge chamber based on a pressure exerted by the first fluid on the retractable plunger;

a bypass sub downhole from the retractable plunger; and at least one pressure release valve (PRV) housed in a PRV sub uphole of the retractable plunger, the at least one PRV operable to open and release at least a portion of the first fluid to the bypass sub along a bypass channel outside the inner housing based on a pressure exerted by the first fluid on the at least one PRV, wherein operation of the retractable plunger and the at least one PRV, while the first fluid is being pumped into the inner housing, generates pulses of the first fluid used to deposit a sealing plug at a target interval of a wellbore.

2. The plugging tool of claim 1, wherein a first frequency of the pulses of the first fluid generated by the plugging tool is lower than a second frequency of pulses of a second fluid generated by a wash tool used to wash the target interval of the wellbore.

3. The plugging tool of claim 1, wherein the discharge chamber comprises a pressure activated sleeve, wherein the pressure activated sleeve is configured to open at least one cementing port adjacent to the discharge chamber when a pressure of the first fluid or the second fluid in the discharge chamber equals or exceeds a pressure threshold, wherein the pulses of first fluid exit from the discharge chamber through the at least one cementing port.

4. The plugging tool of claim 2, wherein:

the inner housing is configured to allow the second fluid to pass through to the wash tool positioned downhole from the plugging tool.

5. The plugging tool of claim 1, wherein the at least one PRV is configured to:

open to release the first fluid from the inner housing when the pressure exerted by the first fluid on the at least one PRV equals or exceeds a threshold pressure; and close to block the first fluid from exiting the inner housing through the at least one PRV when the pressure exerted by the first fluid on the at least one PRV falls below the threshold pressure.

6. The plugging tool of claim 1, further comprising a plunger seat positioned within the inner housing downhole from the retractable plunger, wherein the first fluid flows through the plunger seat into the discharge chamber.

7. The plugging tool of claim 6, wherein:

the plunger comprises a plunger shaft and a plunger head positioned at a downhole end of the plunger shaft; and the plunger is configured to move along the length of the inner housing when pushed by the flow of the first fluid with at least a threshold pressure such that the plunger head seals against the plunger seat to obstruct the flow of the first fluid into the discharge chamber.

8. The plugging tool of claim 7, further comprising:

at least one plunger spring positioned within the housing near the plunger, wherein the plunger spring is configured to spring load the plunger when the plunger is pushed by the first fluid and retract the plunger away from the plunger seat to resume the flow of the first fluid into the discharge chamber when the pressure exerted by the first fluid on the plunger drops below the threshold pressure.

9. The plugging tool of claim 7, further comprising at least one plunger weight mounted on the plunger, wherein the plunger weight is selected to achieve a pre-selected frequency of the pulses of the first fluid.

10. The plugging tool of claim 7, further comprising an outer housing positioned over the inner housing and forming at least a portion of the bypass channel between the inner housing and the outer housing.

11. The plugging tool of claim 10, wherein the outer housing is concentrically positioned over the inner housing creating an annulus between an outer surface of the inner housing and an inner surface of the outer housing, wherein the annulus forms at least a portion of the bypass channel.

12. The plugging tool of claim 1, wherein the first fluid comprises a cement slurry.

13. A method for sealing a wellbore using a plugging tool, comprising:

pumping a first fluid into an inner housing of the plugging tool;

generating pulses of the first fluid by cycling through a plurality of operations comprising:

obstructing a flow of the first fluid into a discharge chamber by moving a plunger within the inner housing in a downhole direction when a pressure exerted by the first fluid on the plunger equals or exceeds a first threshold pressure;

releasing a portion of the first fluid from the inner housing by opening at least one pressure release valve (PRV) when the pressure exerted by the first fluid on the at least one PRV equals or exceeds a second pressure threshold;

routing the released portion of the first fluid to a bypass sub downhole of the plunger along a bypass channel outside the inner housing;

resuming the flow of the first fluid into the discharge chamber by moving the plunger within the inner housing in an uphole direction when the pressure exerted by the first fluid on the plunger falls below the first threshold pressure; and blocking the first fluid from exiting the inner housing through the at least one PRV by closing the at least one PRV in response to the pressure exerted by the first fluid on the at least one PRV falling below the second pressure threshold.

14. The method of claim 13, wherein a first frequency of the pulses of the first fluid generated by the plugging tool is lower than a second frequency of pulses of a second fluid generated by a wash tool used to wash the target interval of the wellbore.

15. The method of claim 14, further comprising opening a pressure activated sleeve positioned in the discharge chamber when a pressure of the first fluid or the second fluid in the discharge chamber equals or exceeds a third pressure threshold, wherein the open pressure activated sleeve allows the pulses of first fluid to exit from the discharge chamber through at least one cementing port adjacent to the pressure activated sleeve.

16. The method of claim 15, wherein opening the pressure activated sleeve comprises pumping the first fluid or the second fluid into the plugging tool to increase a corresponding fluid pressure in the discharge chamber to equal or exceed the third pressure threshold.

17. The method of claim 13, wherein obstructing the flow of the first fluid into the discharge chamber comprises moving the plunger along the length of the inner housing in the downhole direction such that a plunger head of the plunger seals against a plunger seat to obstruct the flow of the first fluid into the discharge chamber.

18. The method of claim 17, wherein resuming the flow of the first fluid into the discharge chamber comprises retracting the plunger away from the plunger seat using a plunger spring positioned near the plunger to resume the flow of the first fluid into the discharge chamber.

19. The method of claim 17, further comprising mounting at least one plunger weight on the plunger to achieve a pre-selected frequency of the pulses of the first fluid.

* * * * *